US010962188B2

(12) United States Patent
Ikuta

(10) Patent No.: US 10,962,188 B2
(45) Date of Patent: Mar. 30, 2021

(54) VEHICLE LAMP

(71) Applicant: KOITO MANUFACTURING CO., LTD., Tokyo (JP)

(72) Inventor: Ryujiro Ikuta, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 16/788,398

(22) Filed: Feb. 12, 2020

(65) Prior Publication Data

US 2020/0256534 A1 Aug. 13, 2020

(30) Foreign Application Priority Data

Feb. 12, 2019 (JP) ..... JP2019-023073

(51) Int. Cl.

| | |
|---|---|
| ***F21S 41/147*** | (2018.01) |
| ***F21S 41/36*** | (2018.01) |
| ***F21S 41/25*** | (2018.01) |
| *F21W 102/155* | (2018.01) |

(52) U.S. Cl.

CPC ..... *F21S 41/147* (2018.01); *F21S 41/25* (2018.01); *F21S 41/36* (2018.01); *F21W 2102/155* (2018.01)

(58) Field of Classification Search

CPC ..... F21S 41/25; F21S 41/151; F21S 41/663; F21S 41/141; F21S 41/147; F21W 2102/10–165

See application file for complete search history.

(56) References Cited

U.S. PATENT DOCUMENTS

| | | | | |
|---|---|---|---|---|
| 2005/0068787 | A1* | 3/2005 | Ishida | F21S 41/147 362/538 |
| 2009/0196060 | A1* | 8/2009 | Sazuka | B60Q 1/14 362/509 |
| 2012/0201040 | A1* | 8/2012 | Naganawa | F21S 41/145 362/487 |
| 2014/0016343 | A1* | 1/2014 | Brendle | F21S 41/60 362/518 |
| 2015/0043236 | A1* | 2/2015 | Yamamoto | F21S 41/148 362/516 |

(Continued)

FOREIGN PATENT DOCUMENTS

JP 2017-076552 A 4/2017

*Primary Examiner* — Mariceli Santiago
(74) *Attorney, Agent, or Firm* — Osha Bergman Watanabe & Burton LLP

(57) ABSTRACT

A vehicle lamp includes a lamp unit configured such that emitted light from a light source is emitted toward the front of the lamp via a projection lens. The lamp unit includes first and second light sources as the light source, which are turned on at respective required turning on modes. The first light source includes at least one light emitting element disposed in a vicinity of a rear focal point of the projection lens. The second light source includes at least one light emitting element disposed at a position obtained by being moved from the rear focal point in a front-rear direction above the rear focal point. Light emitting elements including the first and second light source respectively are mounted on the same substrate extending obliquely in the front-rear direction of the lamp relative to a vertical plane orthogonal to the front-rear direction of the lamp.

5 Claims, 12 Drawing Sheets

(56) References Cited

U.S. PATENT DOCUMENTS

| | | | | |
|---|---|---|---|---|
| 2016/0305628 | A1* | 10/2016 | Lin | F21S 41/36 |
| 2017/0227184 | A1* | 8/2017 | Ishida | F21S 41/148 |
| 2017/0343173 | A1* | 11/2017 | Takada | F21S 41/147 |
| 2018/0347777 | A1* | 12/2018 | Chen | F21S 41/32 |
| 2019/0093873 | A1* | 3/2019 | Nishi | F21S 41/321 |

* cited by examiner

VEHICLE LAMP

CROSS-REFERENCE TO RELATED APPLICATIONS

The present application claims priority from Japanese Patent Application No. 2019-023073, filed on Feb. 12, 2019, the entire content of which is incorporated herein by reference.

TECHNICAL FIELD

The present invention relates to a vehicle lamp including a projector lamp unit.

BACKGROUND ART

Commonly, a vehicle lamp, which includes a projector lamp configured such that emitted light from a light source is emitted toward the front of the lamp via a projection lens, has been known.

JP-A-2017-076552 discloses a vehicle lamp including a first lamp unit in which a plurality of first light emitting elements are disposed in parallel in a left-right direction on a rear focal plane of a projection lens, and a second lamp unit in which a plurality of second light emitting elements are disposed in parallel in the left-right direction on a rear side of the lamp relative to the rear focal plane of the projection lens.

In the vehicle lamp described in JP-A-2017-076552, emission light from the first lamp unit forms a bright and clear light distribution pattern as a projection image of the plurality of first light emitting elements, and emission light from the second lamp unit forms an unclear light distribution pattern larger than the above light distribution pattern as a projection image of the plurality of second light emitting elements.

SUMMARY

According to operation with the configuration described in JP-A-2017-076552 described above, a bright and clear light distribution pattern and a large and unclear light distribution pattern can be selectively or simultaneously formed, but two lamp units are required to realize this effect.

The present invention has been made in view of the above circumstances, and an object thereof is to provide a vehicle lamp including a projector lamp unit, which can selectively or simultaneously form a bright and clear light distribution pattern and a large and unclear light distribution pattern by a single lamp unit and a simple configuration.

One aspect of the present invention is intended to achieve the above object by devising the configuration and arrangement of the light source.

That is, the vehicle lamp according to the present invention includes a lamp unit configured such that emitted light from a light source is emitted toward the front of the lamp via a projection lens. The lamp unit includes first and second light sources as the light source, which are turned on at respective desired turning on modes. The first light source includes at least one light emitting element disposed in a vicinity of a rear focal point of the projection lens, and the second light source includes at least one light emitting element disposed at a position obtained by being moved from the rear focal point in a front-rear direction above the rear focal point. Light emitting elements including the first light source and light emitting elements including the second light source are mounted on the same substrate extending obliquely in the front-rear direction of the lamp relative to a vertical plane orthogonal to the front-rear direction of the lamp.

The "required turning on mode" is not limited to a specific turning on mode, and may be, for example, a low-beam turning on mode, a high-beam turning on mode, a fog lamp turning on mode, a driving lamp turning on mode, and a daytime running lamp turning on mode.

The number of the light emitting elements and specific arrangement of the "first light source" is not particularly limited as long as the "first light source" includes at least one light emitting element disposed in the vicinity of the rear focal point of the projection lens.

The number of the light emitting elements and specific arrangement of the "second light source" is not particularly limited as long as the "second light source" is disposed at a position obtained by being moved from the rear focal point in the front-rear direction of the lamp above the rear focal point of the projection lens.

The inclination direction and the specific inclination angle of the "substrate" is not particularly limited as long as the "substrate" extends obliquely in the front-rear direction of the lamp relative to the vertical plane orthogonal to the front-rear direction of the lamp.

A vehicle lamp according to the present invention includes a lamp unit configured such that emitted light from a light source is emitted toward the front of the lamp via a projection lens. The lamp unit includes first and second light sources as the light source, which are turned on at respective desired turning on modes. The first light source includes at least one light emitting element disposed in a vicinity of a rear focal point of the projection lens, and the second light source includes at least one light emitting element disposed at a position obtained by being moved from the rear focal point in a front-rear direction above the rear focal point. Accordingly, the following effects can be obtained.

That is, the first light source is turned on, whereby a bright and clear first light distribution pattern can be formed as a projection image of at least one light emitting element constituting the first light source. In addition, the second light source is turned on, whereby an unclear second light distribution pattern larger than the first light distribution pattern can be formed, below the first light distribution pattern, as a projection image of at least one light emitting element constituting the second light source.

Moreover, the light emitting elements constituting the first light source and the light emitting elements constituting the second light source are mounted on the same substrate extending obliquely in the front-rear direction of the lamp relative to the vertical plane orthogonal to the front-rear direction of the lamp, so that the above effects can be obtained while simplifying the configuration of the lamp unit.

As described above, in the vehicle lamp including the projector lamp unit according to the present invention, a bright and clear light distribution pattern and a large and unclear light distribution pattern can be selectively or simultaneously formed by a single lamp unit and a simple configuration.

Furthermore in the above configuration, a light emitting area of the second light source may be set to a value larger than a light emitting area of the first light source. When a light emitting area of the second light source is set to a value larger than a light emitting area of the first light source, the clear first light distribution pattern can be formed as a relatively small light distribution pattern, and meanwhile the second light distribution pattern can be formed as an unclear light distribution pattern that is sufficiently larger than the first light distribution pattern.

At this time, as a specific configuration for setting the light emitting area of the second light source to a value larger than the light emitting area of the first light source, the light emitting surface of the light emitting element may be expanded or the number of light emitting elements may be increased.

Furthermore in the above configuration, the vehicle lamp further may include a second lamp unit that can selectively form a low-beam light distribution pattern and a high-beam light distribution pattern, and based on the configuration of the above lamp unit, brightness of the low-beam light distribution pattern can be reinforced by turning on the second light source, and brightness of high-beam light distribution pattern can be reinforced by turning on the first light source. Accordingly, the following effects can be obtained.

That is, the first light distribution pattern formed by turning on the first light source is a bright and clear light distribution pattern, so that the brightness of a center region of the high-beam light distribution pattern can be reinforced by additional formation of the first light distribution pattern.

On the other hand, the second light distribution pattern, which is formed below the first light distribution pattern by turning on the second light source, is a large and unclear light distribution pattern, so that the brightness of a diffusion region of the low-beam light distribution pattern can be reinforced while unevenness of light distribution is reduced, by additional formation of the second light distribution pattern.

When the first light source is turned on, the second light source may also be turned on at the same time to form a second light distribution pattern. As a result, not only the brightness of the center region of the high-beam light distribution pattern can be reinforced, but also the brightness of the diffusion region can be reinforced while unevenness of light distribution is reduced.

Furthermore in the above configuration, the substrate may be inclined toward the front of the lamp relative to the vertical plane orthogonal to the front-rear direction of the lamp. When the substrate is inclined toward the front of the lamp relative to the vertical plane orthogonal to the front-rear direction of the lamp, the emitted light from the second light source disposed above the rear focal point of the projection lens can be efficiently incident on the projection lens.

Furthermore in the above configuration, the lamp unit may include a pair of reflectors disposed on both left and right sides of the second light source, the reflectors may reflect the emitted light from the second light source toward the projection lens. When the reflectors reflect the emitted light from the second light source toward the projection lens, lateral diffusion angles of the second light distribution pattern can be increased. Moreover, the light distribution pattern formed by the reflection light from the reflectors becomes an unclear light distribution pattern much larger than the second light distribution pattern, so that the diffusion region thereof can be expanded to both the left and right sides while reducing the unevenness of light distribution of the low-beam light distribution pattern.

BRIEF DESCRIPTION OF DRAWINGS

FIG. 4A shows a low-beam light distribution pattern, and FIG. 4B shows a high-beam light distribution pattern.

DETAILED DESCRIPTION OF EMBODIMENTS

An embodiment of the present invention will be described below with reference to the drawings.

Figure 1:
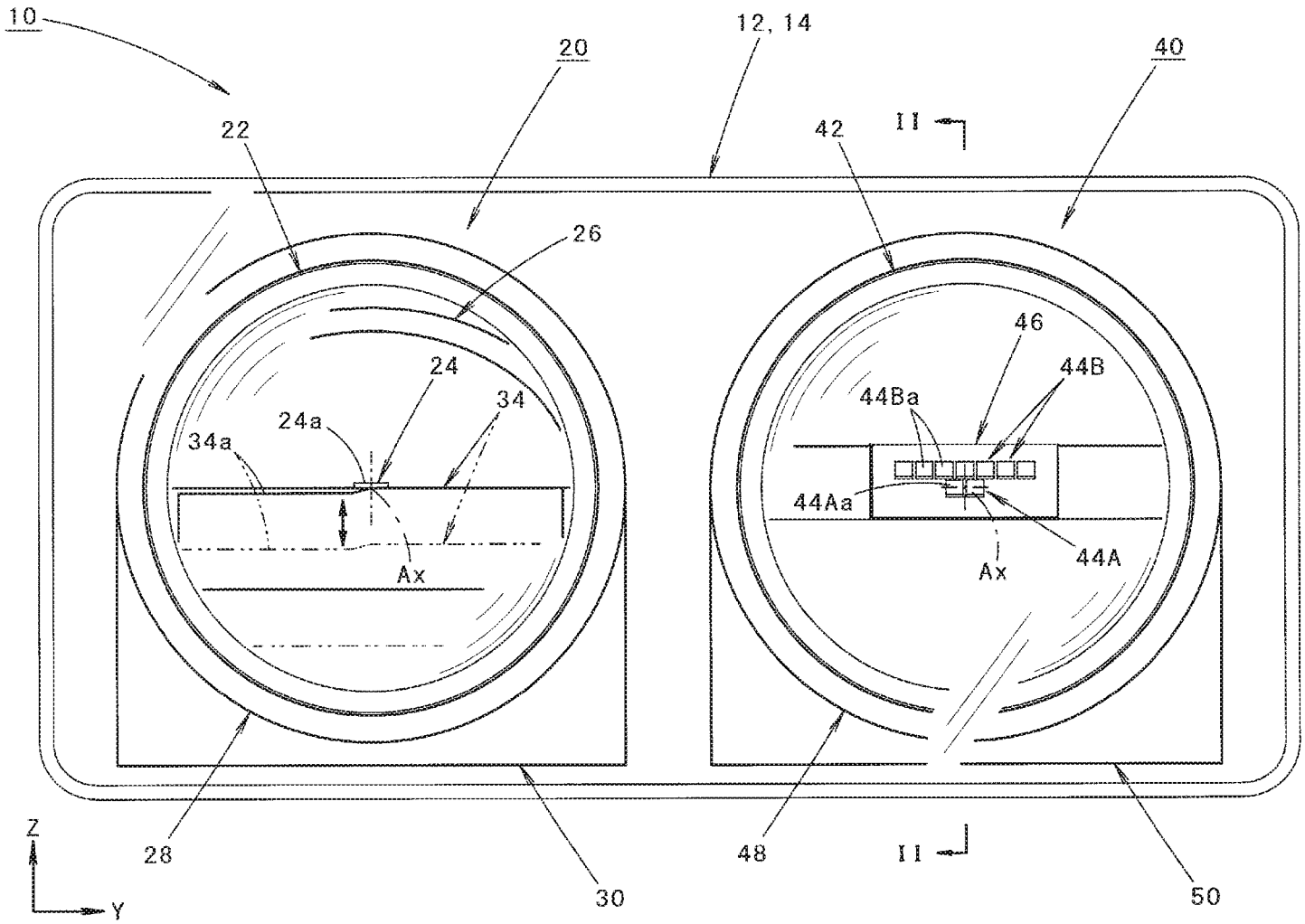
FIG. 1 is a front view showing a vehicle lamp according to an embodiment of the present invention.
Figure 2:
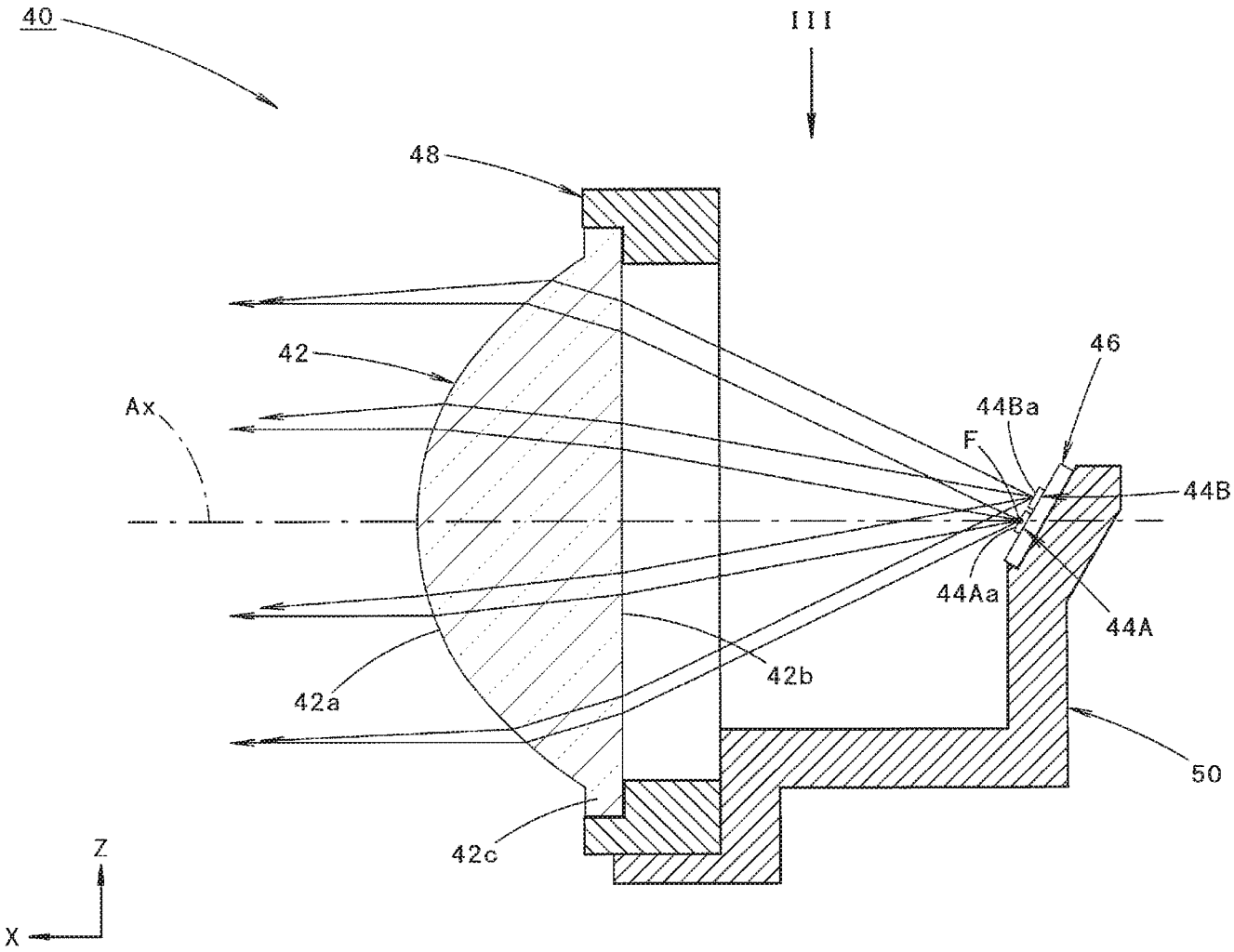
FIG. 2 is a sectional view taken along a line II-II in FIG. 1.
Figure 3:
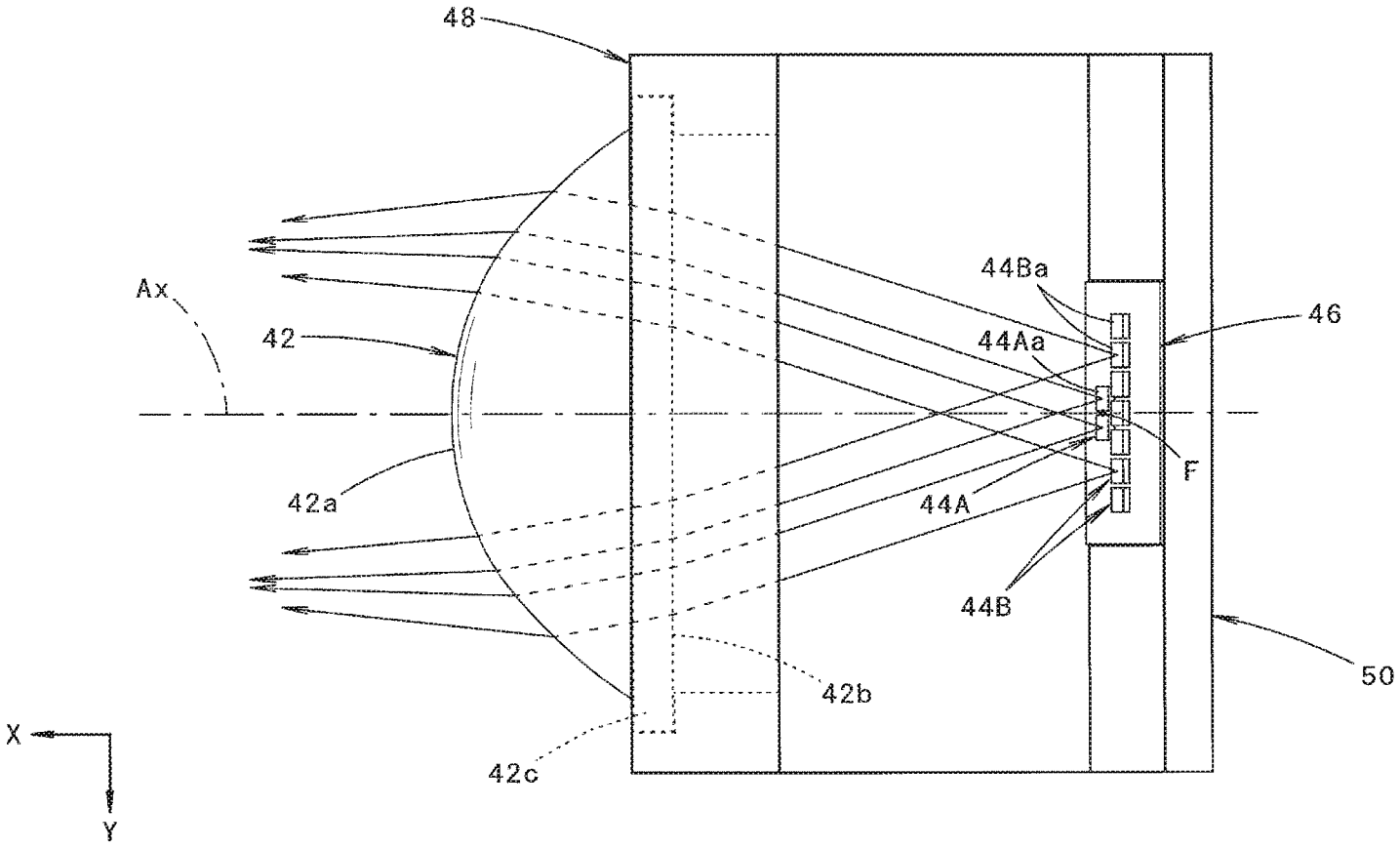
FIG. 3 is a view taken along a direction of an arrow III in FIG. 2.

FIG. 1 is a front view showing a vehicle lamp 10 according to an embodiment of the present invention. Further, FIG. 2 is a sectional view taken along a line II-II in FIG. 1, and FIG. 3 is a view taken along a direction of an arrow III in FIG. 2.

In these drawings, a direction indicated by X is the "front" of the vehicle lamp 10 (also the "front" of a vehicle), a direction indicated by Y is a "left direction" orthogonal to the "front" ("left direction" of a vehicle, but "right direction" when viewing a lamp from front), and a direction indicated by Z is an "upper" direction. The same applies to the other drawings.

As shown in these drawings, the vehicle lamp 10 according to the present embodiment is a headlamp provided at a front end portion of a vehicle, and has a configuration in which two projector lamp units 20 and 40 are incorporated in a lamp chamber formed by a lamp body 12 and a transparent cover 14 attached to a front end opening portion of the lamp body 12.

The lamp unit 20 selectively forms a low-beam light distribution pattern and a high-beam light distribution pattern, and the lamp unit 40 reinforces brightness of the low-beam light distribution pattern and the high beam-light distribution pattern. First, a configuration of the lamp unit 20 will be described.

As shown in FIG. 1, the lamp unit 20 is a lamp unit of a reflection light control type. The lamp unit 20 includes: a projection lens 22 having an optical axis Ax extending in a front-rear direction of the lamp; a light emitting element 24 as a light source disposed on a rear side of the lamp relative to a rear focal point of the projection lens 22; and a reflector 26 that covers the light emitting element 24 from above and reflects light from the light emitting element 24 toward the projection lens 22.

The light emitting element 24 is a white light emitting diode including a horizontally-long rectangular light emitting surface, and is supported by a base member 30 with a light emitting surface 24*a* thereof facing upward on the optical axis Ax. The reflector 26 is also supported by the base member 30 at a lower end edge thereof. In addition, the projection lens 22 is supported by the base member 30 via a lens holder 28.

The lamp unit 20 further includes a movable shade 34, which is configured such that it is possible to select a light shielding position (a position indicated by a solid line in FIG. 1) where a part of reflection light from the reflector 16 toward the projection lens 22 is shielded and a light shielding release position (a position indicated by a two-dot chain line) where the light shielding is released, and an actuator (not shown) for driving the movable shade 34.

When the movable shade 34 is in the light shielding position, an upper end edge 34*a* of the movable shade 34 passes through the rear focal point of the projection lens 22. Accordingly, the lamp unit 20 forms a low-beam light distribution pattern having a cut-off line at an upper end edge when the movable shade 34 is in the light shielding position, and meanwhile, forms a high-beam light distribution pattern when the movable shade 34 is in the light shielding release position.

Next, a configuration of the lamp unit 40 will be described.

As shown in FIGS. 1 to 3, the lamp unit 40 is a lamp unit of a direct light control type. The lamp unit 40 includes: a projection lens 42 having an optical axis Ax extending in a front-rear direction of the lamp; two light emitting elements 44A as a first light source disposed in a vicinity of a rear focal point F of the projection lens 42; and seven light emitting elements 44B as a second light source disposed on a rear side of the lamp relative to the rear focal point F above the rear focal point F.

The light emitting elements 44A are a white light emitting diode including a square light emitting surface 44Aa. The light emitting elements 44A are disposed in a state of being close to each other on both left and right sides of the rear focal point F at a height position of the optical axis Ax and in a state where the light emitting surface 44Aa thereof is directed obliquely upward toward the front of the lamp. At this time, an obliquely upward angle of the light emitting elements 44A is set to a value of about 10° to 20° (for example, about 15°).

The light emitting elements 44B are a white light emitting diode that includes a square light emitting surface 44Ba having the same size as the light emitting surface 44Aa of each of the light emitting elements 44A. The light emitting elements 44B are disposed in a state of being close to one another directly above the optical axis Ax and on both left and right sides thereof, and being close to the two light emitting elements 44A. The light emitting elements 44B are disposed in a state where the light emitting surfaces 44Ba thereof are directed in the same direction as those of the light emitting elements 44A (that is, obliquely upward direction toward the lamp).

The two light emitting elements 44A and the seven light emitting elements 44B are mounted on the same substrate 46 extending obliquely to the rear side of the lamp relative to a vertical plane orthogonal to the front-rear direction of the lamp. The substrate 46 is supported by a base member 50.

The two light emitting elements 44A are turned on at a high-beam turning on mode, and the seven light emitting elements 44B light up at a low-beam turning on mode.

The projection lens 42 is a plano-convex aspheric lens whose front surface 42*a* is a convex plane and whose rear surface 42*b* is a plane, and projects a light-source image formed on a rear focal plane including the rear focal point F onto a virtual vertical screen ahead of the lamp as a reverse image. The projection lens 42 has a circular outer shape when viewing the lamp from front, and is supported by a lens holder 38 at an outer peripheral flange portion 42*c* of the projection lens 42. The lens holder 38 is supported by the base member 50.

Figure 4A:
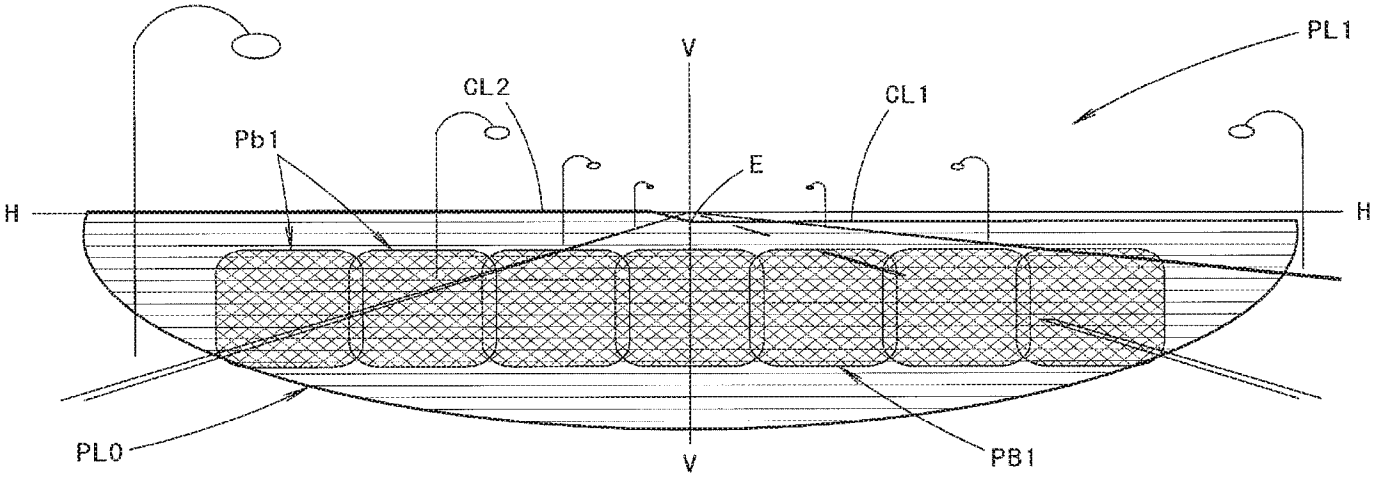
FIGS. 4A and 4B are perspective views of light distribution patterns formed by emission light from the vehicle lamp.
Figure 4B:
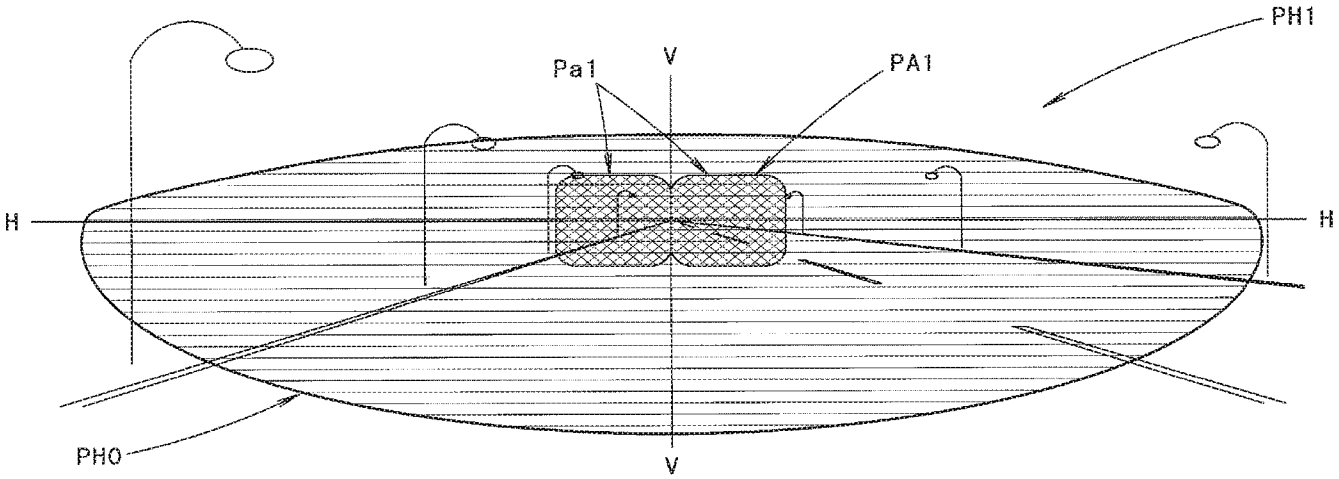

FIGS. 4A and 4B are perspective views of light distribution patterns formed, by light emitted forward from the vehicle lamp 10, on a virtual vertical screen disposed 25*m* ahead of the vehicle. FIG. 4A shows a low-beam light distribution pattern PL1, and FIG. 4B shows a high-beam light distribution pattern PHE The low-beam light distribution pattern PL1 shown in FIG. 4A is a low-beam light distribution pattern for left light distribution, and has cut-off lines CL1 and CL2 having left-right difference, on an upper end edge thereof. The cut-off lines CL1 and CL2 extend at the left-right difference in a horizontal direction with a V-V line as a boundary, which passes through H-V as vanishing points in the front direction of the lamp, in a vertical direction. A right oncoming-vehicle lane side part on the right of the V-V line is formed as the lower cut-off line CL1, and a left own-vehicle lane side part on the left of the V-V line is formed as the upper cut-off line CL2 obtained by rising from the lower cut-off line CL1 via an inclined portion.

In the low-beam light distribution pattern PL1, an elbow point E, which is an intersection of the lower cut-off line CL1 and the V-V line, is positioned below H-V by about 0.5° to 0.6°.

The low-beam light distribution pattern PL1 is formed as a combined light distribution pattern of a basic light distribution pattern PL0 formed by emission light from the lamp unit 20 and an additional light distribution pattern PB1 formed by emission light from the lamp unit 40.

The basic light distribution pattern PL0 is a light distribution pattern forming a basic shape of the low-beam light distribution pattern PL1, and the cutoff lines CL1 and CL2 thereof are formed by the movable shade 34 in the light shielding position at the low-beam turning on mode.

The additional light distribution pattern PB1 is formed, by turning on the seven light emitting elements 44B, as a diffusion light distribution pattern for reinforcing the brightness of the diffusion region of the basic light distribution pattern PL0. Details of the additional light distribution pattern PB1 will be described below.

The high-beam light distribution pattern PH1 shown in FIG. 4B is formed as a combined light distribution pattern of a basic light distribution pattern PH0 formed by emission light from the lamp unit 20 and an additional light distribution pattern PA1 formed by emission light from the lamp unit 40.

The basic light distribution pattern PH0 is a light distribution pattern forming a basic shape of the high-beam light distribution pattern PH1, and is formed as a light distribution pattern obtained when the basic light distribution pattern PL0 expands to a position above the cut-off lines CL1 and CL2 by moving the movable shade 34 to the light shielding release position at the high-beam turning on mode.

The additional light distribution pattern PA1 is formed, by turning on the two light emitting elements 44A, as a condensing light distribution pattern for reinforcing the brightness of a central region of the basic light distribution pattern PH0.

The additional light distribution pattern PA1 is formed as a horizontally-long bright light distribution pattern having a spot shape centered on H-V. At this time, the additional light distribution pattern PA1 is formed by a pair of left and right light distribution patterns Pa1 adjacent to each other across the V-V line.

The light distribution patterns Pa1 are formed as reverse projection images of the light emitting elements 44A formed by the projection lens 42. At this time, since the light emitting elements 44A are disposed close to each other on the left and right sides of the rear focal point F of the projection lens 42, the light distribution patterns Pa1 are formed, in a state of being substantially in close contact with each other, as a small and bright light distribution pattern having a substantially rectangular shape. Since the light emitting surfaces 44Aa of the light emitting elements 44A are inclined to the rear side of the lamp relative to the vertical plane orthogonal to the optical axis Ax, the light distribution patterns Pa1 are formed as light distribution patterns having a slightly horizontally-long rectangular shape.

On the other hand, the additional light distribution pattern PB1 of the low-beam light distribution pattern PL1 shown in FIG. 4A is formed, as a horizontally-long light distribution pattern expanding in the left-right direction with the V-V line as a center, below the cut-off lines CL1 and CL2. As a result, the brightness of the diffusion region of the low-beam light distribution pattern PL1 is increased.

The additional light distribution pattern PB1 is formed of seven light distribution patterns Pb1 positioned on the V-V line and on both left and right sides thereof.

The light distribution patterns Pb1 are formed as reverse projection images of the light emitting elements 44B formed by the projection lens 42. At this time, the light emitting elements 44B are disposed on the rear side of the lamp relative to the rear focal point F above the rear focal point F of the projection lens 42, so that the light distribution patterns Pb1 are formed, in a state of being partially overlapped with each other, as unclear light distribution patterns having a substantially rectangular shape larger than that of the light distribution patterns Pa1, and positions of upper end edges thereof are positioned slightly above positions of lower end edges of the light distribution patterns Pa1.

Next, the effects of the present embodiment will be described.

The vehicle lamp 10 according to the present embodiment includes the projector lamp unit 40 as a light source including the first light source turned on at a high-beam turning on mode and the second light source turned on at the low-beam turning on mode. The first light source includes the two light emitting elements 44A disposed in a vicinity of the rear focal point F of the projection lens 42, and the second light source includes the seven light emitting elements 44B disposed at positions obtained by being moved from the rear focal point F to the rear side of the lamp above the rear focal point F of the projection lens 42. Accordingly, the following effects can be obtained.

That is, the two light emitting elements 44A are turned on, whereby the bright and clear high-beam additional light distribution pattern PA1 (first light distribution pattern) can be formed as a projection image. In addition, the seven light emitting elements 44B are turned on, whereby the unclear low-beam additional light distribution pattern PB1 (second light distribution pattern), which is larger than the additional light distribution pattern PA1, can be formed as a projection image below the additional light distribution pattern PAL In addition, the two light emitting elements 44A and the seven light emitting elements 44B are mounted on the same substrate 46 extending obliquely to the rear side of the lamp relative to the vertical plane orthogonal to the front-rear direction of the lamp, so that the configuration of the lamp unit 40 can be simplified and the above effects can be obtained.

As described above, in the vehicle lamp 10 including the projector lamp unit 40 according to the present embodiment, it is possible to selectively or simultaneously form the bright and clear additional light distribution pattern PA1 and the large and unclear additional light distribution pattern PB1 by the single lamp unit 40 and a simple configuration.

Moreover, a light emitting area of the second light source including the seven light emitting elements 44B is set to a value larger than a light emitting area of the first light source including the two light emitting elements 44A in the present embodiment, so that the clear additional light distribution pattern PA1 can be formed as a relatively small light distribution pattern, and meanwhile, the additional light distribution pattern PB1 can be formed as an unclear light distribution pattern sufficiently larger than the additional light distribution pattern PAL Further, the vehicle lamp 10 according to the present embodiment includes the lamp unit 20 (second lamp unit) that selectively forms the low-beam light distribution pattern PL1 and the high-beam light distribution pattern PH1, and further, the lamp unit 40 is configured such that the brightness of the low-beam light distribution pattern PL1 is reinforced by turning on the seven light emitting elements 44B, and the brightness of the high-beam light distribution pattern PH1 is reinforced by turning on the two light emitting elements 44A, so that the following effects can be obtained.

That is, the additional light distribution pattern PA1 formed by turning on the two light emitting elements 44A is a bright and clear light distribution pattern, so that the brightness of a center region of the high-beam light distribution pattern PH1 can be reinforced by the additional formation of the additional light distribution pattern PAL On the other hand, the additional light distribution pattern PB1 formed by turning on the seven light emitting elements 44B is a large and unclear light distribution pattern, so that the brightness of the diffusion region of the low-beam light distribution pattern PL1 can be reinforced while unevenness of light distribution is reduced, by the additional formation of the additional light distribution pattern PB1.

Although the above embodiment describes a configuration in which the first light source includes the two light emitting elements 44A and the second light source includes the seven light emitting elements 44B, the first light source and the second light source may include any other number of light emitting elements.

Although the above embodiment describes a configuration in which the light emitting surfaces 44Aa of the light emitting elements 44A and the light emitting surfaces 44Ba of the light emitting elements 44B are formed to have the same size, a configuration, in which the light emitting surfaces 44Aa and 44Ba are formed to have different sizes (for example, a configuration in which the light emitting surfaces 44Aa of the light emitting elements 44A can be formed in a square shape and the light emitting surfaces 44Ba of the light emitting elements 44B are formed in a horizontally-long rectangular shape), may be adopted.

Although the above embodiment describes the lamp unit 20 is a lamp unit of a reflection light control type, the lamp unit 20 may be a lamp unit of a direct light control type, or may be a parabolic lamp unit instead of a projector lamp unit.

Next, modifications of the above embodiment will be described.

First, a first modification of the above embodiment will be described.

Figure 5:
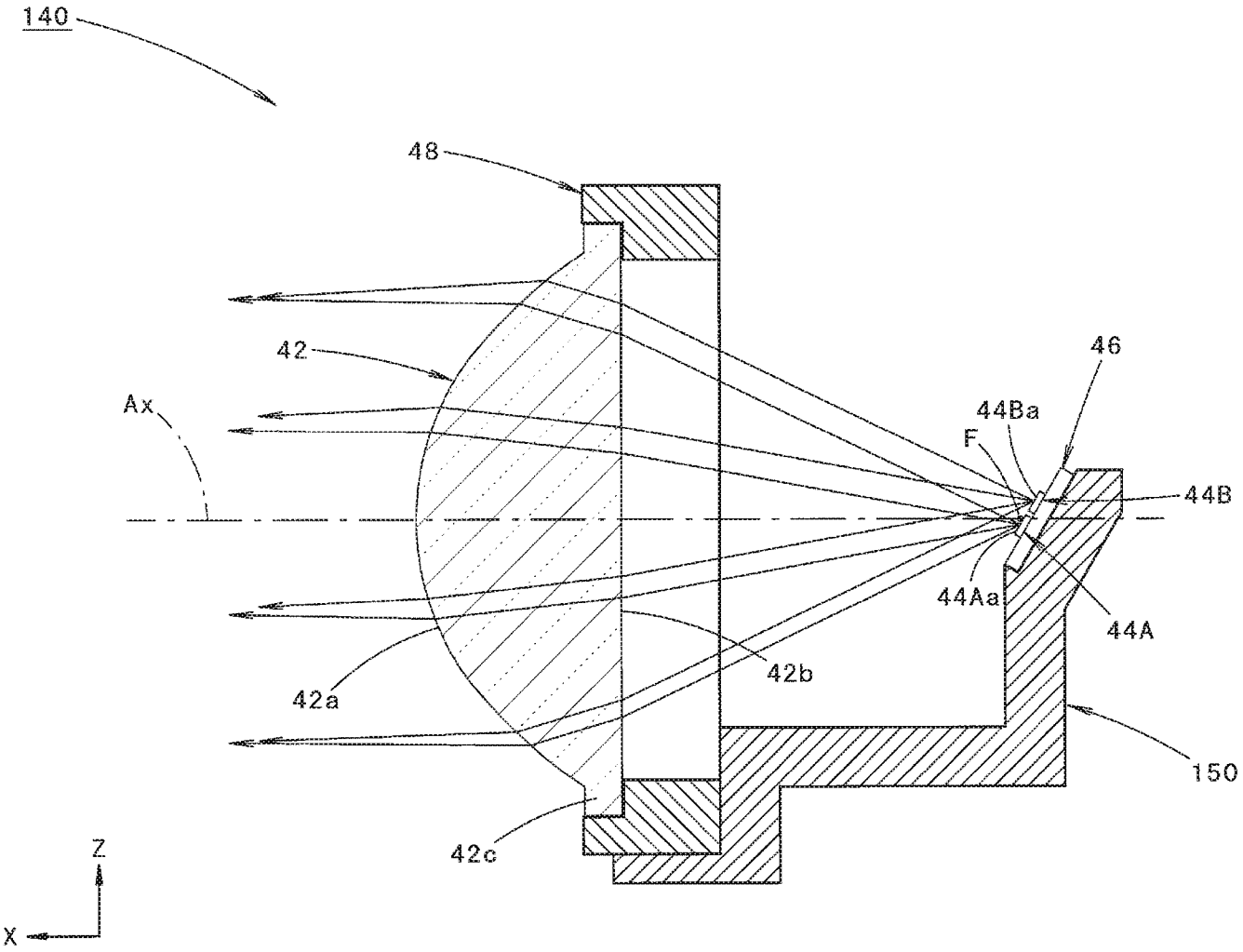
FIG. 5 is a view showing a first modification of the above embodiment, which is similar to FIG. 2.

FIG. 5 is a view showing a lamp unit 140 according to the present modification, which is similar to FIG. 2.

As shown in FIG. 5, the basic configuration of the present modification is the same as that of the above embodiment, but arrangement of the two light emitting elements 44A, the seven light emitting elements 44B, and the substrate 46 is partially different from that of the above embodiment, and accordingly, a configuration of a base member 150 supporting the substrate 46 is partially different from that of the above embodiment.

Specifically, in the present modification, positions of the two light emitting elements 44A and the seven light emitting elements 44B are slightly moved downward relative to those of the above embodiment, and accordingly, the optical axis Ax of the projection lens 42 is disposed slightly above a center position of the two light emitting elements 44A (that is, a position slightly lower than upper end edges of the two light emitting elements 44A).

In the present modification, when the two light emitting elements 44A are turned on at the high-beam turning on mode, the seven light emitting elements 44B are also turned on at the same time.

Figure 6A:
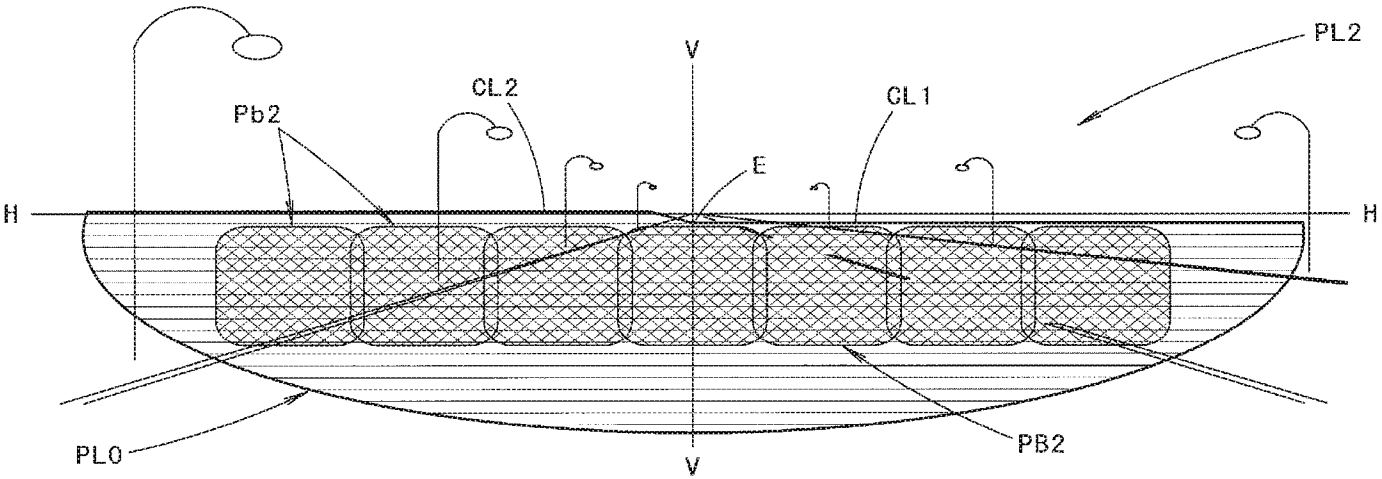
FIGS. 6A and 6B are views showing effects of the first modification, which are similar to FIGS. 4A and 4B.
Figure 6B:
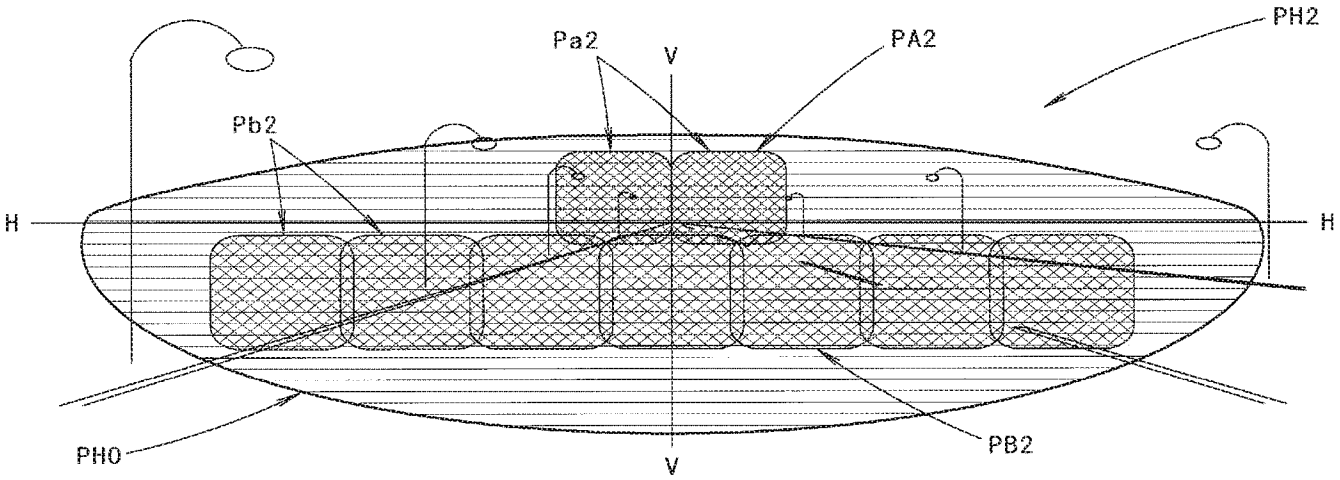

FIGS. 6A and 6B are views showing light distribution patterns formed by emission light from a vehicle lamp including the lamp unit 140 according to the present modification, which are similar to FIGS. 4A and 4B.

A low-beam light distribution pattern PL2 shown in FIG. 6A is formed as a combined light distribution pattern of a basic light distribution pattern PL0 similar to that of the above embodiment and an additional light distribution pattern PB2 formed by emission light from the lamp unit 140.

Similar to the additional light distribution pattern PB1 of the above embodiment, the additional light distribution pattern PB2 is formed of seven light distribution patterns Pb2, and is formed in a state of being displaced upward relative to the additional light distribution pattern PB1 of the above embodiment.

This is because, in the lamp unit 140 according to the present modification, the positions of the seven light emitting elements 44B are moved downward relative to those of the above embodiment. At this time, the amount of downward displacement of the seven light emitting elements 44B is set such that an upper end edge of the additional light distribution pattern PB2 is positioned below and in a vicinity of the lower cutoff line CL1 of the basic light distribution pattern PL0.

A high-beam light distribution pattern PH2 shown in FIG. 6B is formed as a combined light distribution pattern of the basic light distribution pattern PH0 similar to that of the above embodiment and two additional light distribution patterns PA2 and PB2 formed by emission light from the lamp unit 140.

In the high-beam light distribution pattern PH2, the additional light distribution pattern PA2 is formed in a state of being moved upward relative to the additional light distribution pattern PA1 in the high-beam light distribution pattern PH1 of the above embodiment. This is because, in the lamp unit 140 according to the present modification, the positions of the two light emitting elements 44A are also moved downward relative to those of the above embodiment.

In addition, an additional light distribution pattern PB2 is also additionally formed in the high-beam light distribution pattern PH2. The additional light distribution pattern PB2 is formed in a state where an upper end portion thereof overlaps a lower end portion of the additional light distribution pattern PA2.

The following effects can be obtained by adopting the configuration of the present modification.

That is, also in the present modification, the brightness of a diffusion region of the low-beam light distribution pattern PL2 can be reinforced while unevenness of light distribution is reduced, by the additional formation of the additional light distribution pattern PB2. Moreover, the additional light distribution pattern PB2 is formed at a position close to the cut-off lines CL1 and CL2, so that distant visibility for the vehicle forward traveling road can be increased accordingly.

Further, in the present modification, the brightness of a central region of the high-beam light distribution pattern PH2 can be reinforced by the additional formation of the additional light distribution pattern PA2, and the brightness of a diffusion region of the high-beam light distribution pattern PH2 can be reinforced while unevenness of light distribution is reduced, by the additional formation of the additional light distribution pattern PB2.

Next, a second modification of the above embodiment will be described.

Figure 7:
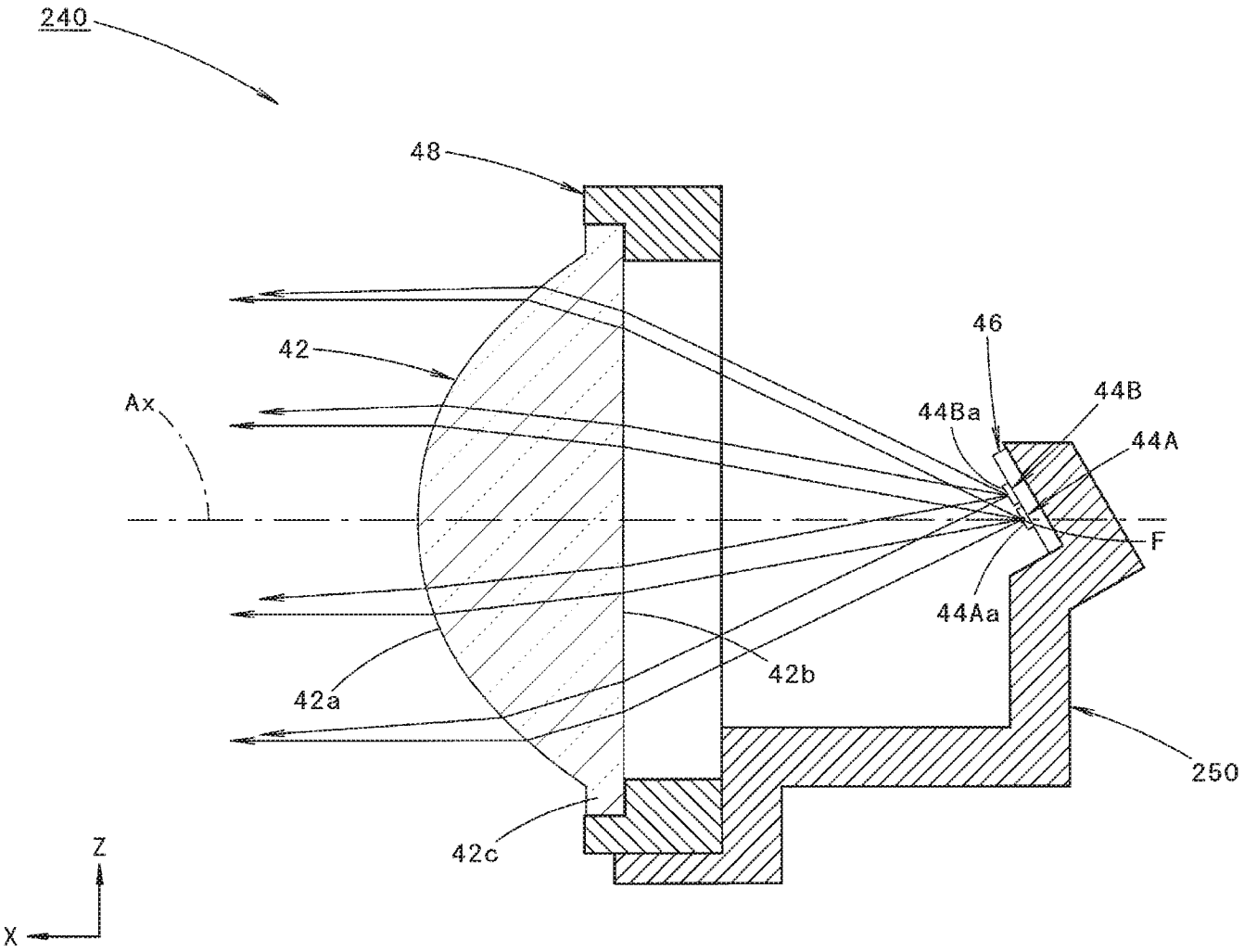
FIG. 7 is a view showing a second modification of the above embodiment, which is similar to FIG. 2.

FIG. 7 is a view showing a lamp unit 240 according to the present modification, which is similar to FIG. 2.

As shown in FIG. 7, the basic configuration of the present modification is the same as that of the above embodiment, but the arrangement of the two light emitting elements 44A, the seven light emitting elements 44B, and the substrate 46 is partially different from that of the above embodiment, and accordingly, a configuration of a base member 250 supporting the substrate 46 is partially different from that of the above embodiment.

Specifically, in the present modification, the substrate 46 is supported by the base member 250 in a state of being inclined to the front side of the lamp relative to a vertical plane orthogonal to the front-rear direction of the lamp. At this time, a forward tilt angle of the substrate 46 is set to the same value as the rearward tilt angle of the substrate 46 of the above embodiment.

The height positions of the two light emitting elements 44A and the seven light emitting elements 44B are the same as those of the above embodiment.

Also in a case of adopting the configuration of the present modification, additional light distribution patterns similar to the additional light distribution patterns PA1 and PB1 of the above embodiment can be formed.

Moreover, in the present modification, the seven light emitting elements 44B disposed above the rear focal point F of the projection lens 42 are disposed in a state where the light emitting surfaces 44Ba thereof are directed obliquely downward toward the front of the lamp, so that emitted light from the light emitting elements 44B can be incident on the projection lens 42 more efficiently than in the case of the above embodiment. Accordingly, an additional light distribution pattern formed by turning on the seven light emitting elements 44B can be brighter than the additional light distribution pattern PB1 of the above embodiment.

Next, a third modification of the above embodiment will be described.

Figure 8:
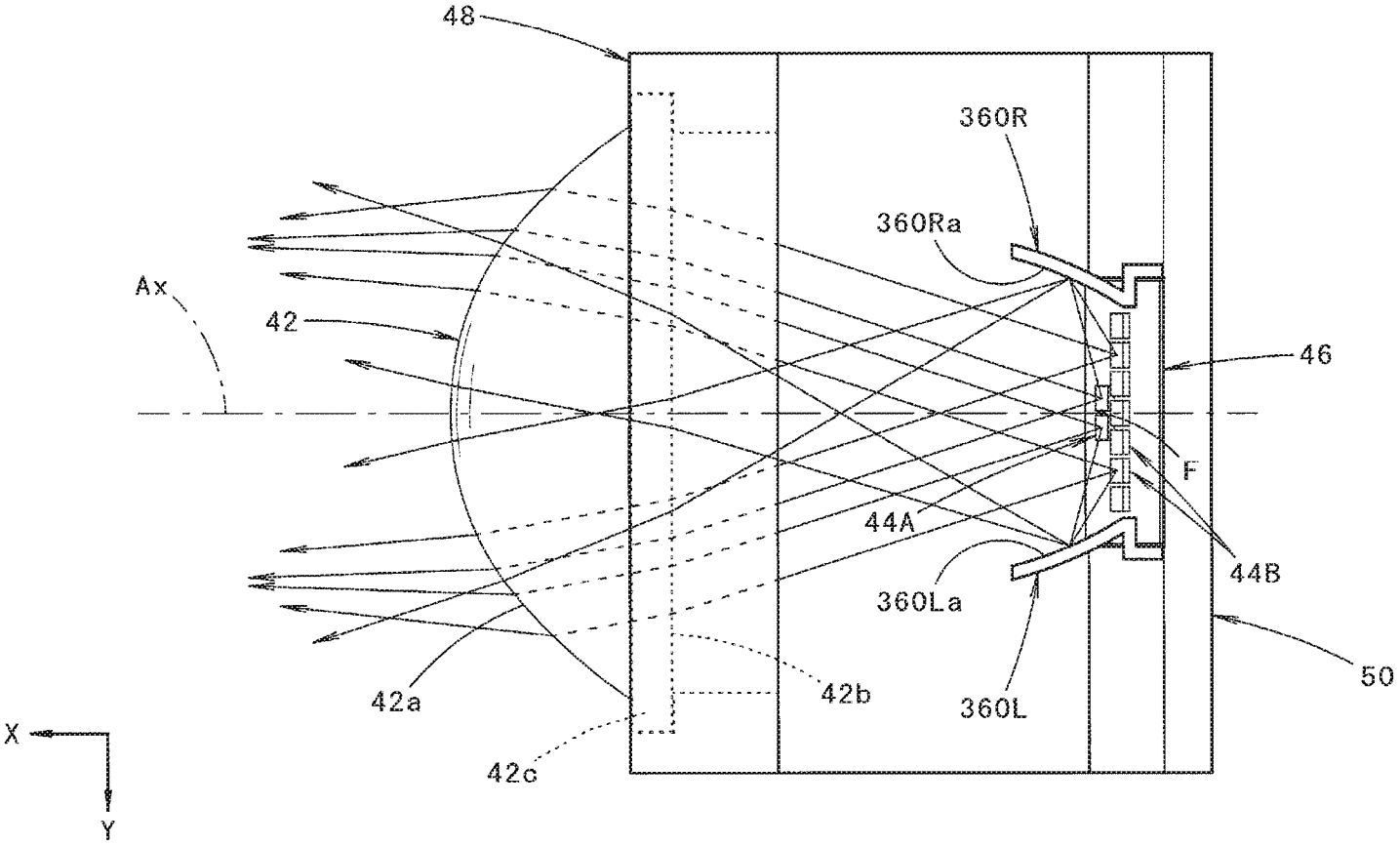
FIG. 8 is a view showing a third modification of the above embodiment, which is similar to FIG. 3.

FIG. 8 is a view showing a lamp unit 340 according to the present modification, which is similar to FIG. 3.

As shown in FIG. 8, the basic configuration of the present modification is the same as that of the above embodiment, but the present modification differs from the above embodiment in that a pair of reflectors 360L and 360R are disposed on left and right sides of the seven light emitting elements 44B separately.

The reflectors 360L and 360R include reflection surfaces 360La and 360Ra respectively, which are formed in a concave curved surface shape, and the reflection surfaces 360La and 360Ra reflect the emitted light from the light emitting elements 44A and 44B to the projection lens 42.

The reflectors 360L and 360R are supported by the base member 50 on left and right sides of the substrate 46 separately.

Figure 9A:
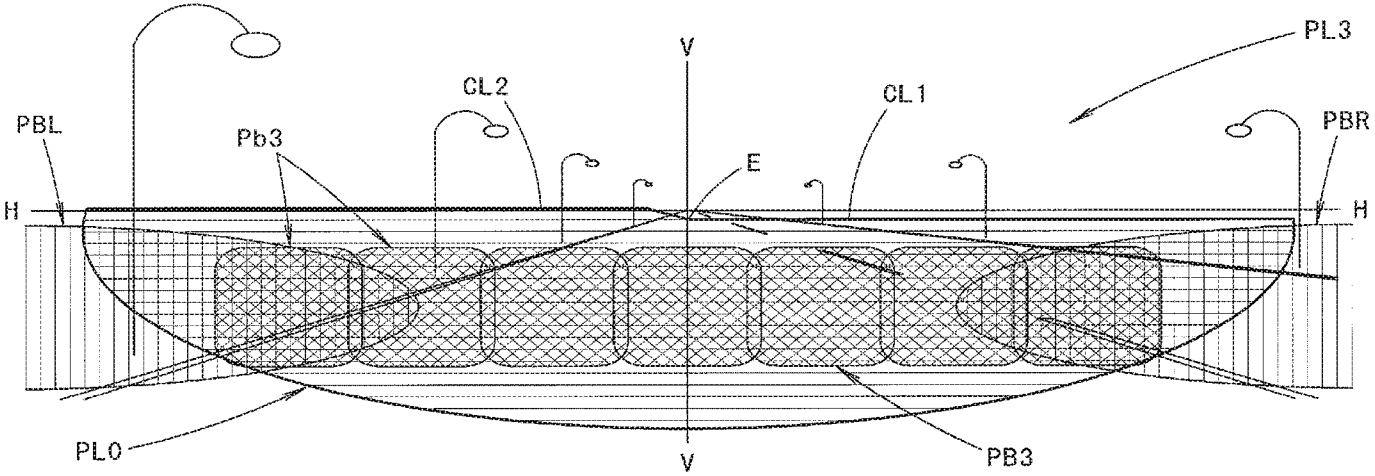
FIGS. 9A and 9B are views showing effects of the third modification, which are similar to FIGS. 4A and 4B.
Figure 9B:
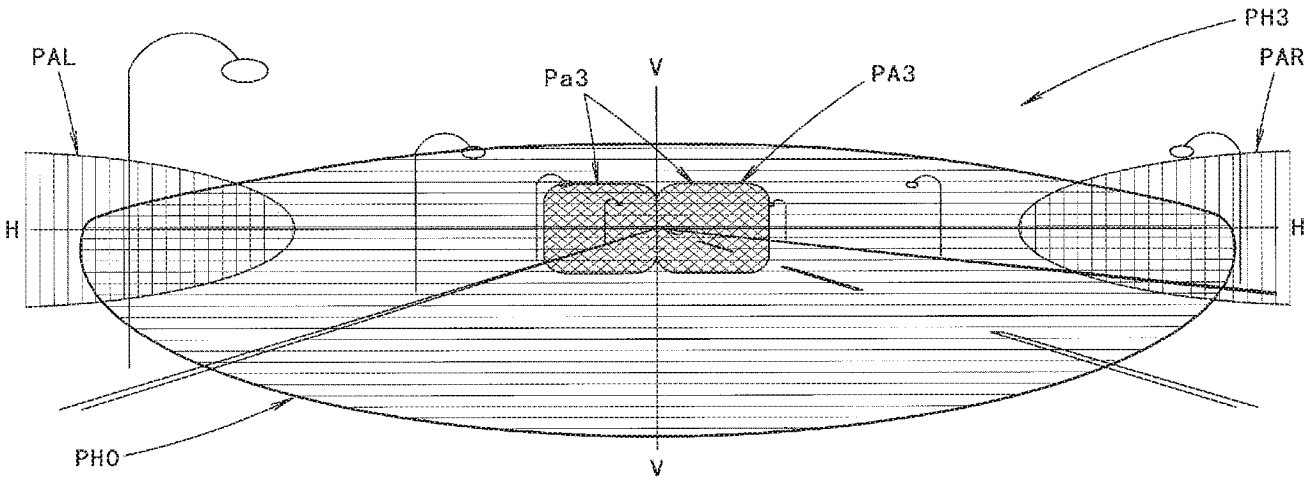

FIGS. 9A and 9B are views showing a light distribution pattern formed by emission light from a vehicle lamp including a lamp unit 340 according to the present modification, which are similar to FIGS. 4A and 4B.

A low-beam light distribution pattern PL3 shown in FIG. 9A is formed as a combined light distribution pattern of a basic light distribution pattern PL0 the same as that of the above embodiment, and an additional light distribution pattern PB3 and a pair of left and right additional light distribution patterns PBL and PBR which are formed by emission light from the lamp unit 340.

Similar to the additional light distribution pattern PB1 of the above embodiment, the additional light distribution pattern PB3 is formed of seven light distribution patterns Pb3.

The left additional light distribution pattern PBL is a light distribution pattern formed by light emitted from the seven light emitting elements 44B and reflected by the reflector 360R positioned on the right side. The additional light distribution pattern PBL is formed as a horizontally-long large light distribution pattern, and partially overlaps a left end portion of the basic light distribution pattern PL0 at a right end portion thereof.

The right additional light distribution pattern PBR is a light distribution pattern formed by light emitted from the seven light emitting elements 44B and reflected by the reflector 360L positioned on the left side. The additional light distribution pattern PBR is formed as a horizontally-long large light distribution pattern, and partially overlaps a right end portion of the basic light distribution pattern PL0 at a left end portion thereof. A high-beam light distribution pattern PH3 shown in FIG. 9B is formed as a combined light distribution pattern of the basic light distribution pattern PH0 similar to that of the above embodiment and an additional light distribution pattern PA3 and a pair of left and right additional light distribution patterns PAL and PAR which are formed by emission light from the lamp unit 140.

Similar to the additional light distribution pattern PB1 of the above embodiment, the additional light distribution pattern PA3 is formed of two light distribution patterns Pa3.

The left additional light distribution pattern PAL is a light distribution pattern formed by light emitted from the two light emitting elements 44A and reflected by the reflector 360R positioned on the right side. The additional light distribution pattern PAL is formed as a horizontally-long light distribution pattern that is relatively large, and partially overlaps a left end portion of the basic light distribution pattern PH0 at a right end portion thereof.

The right additional light distribution pattern PBR is a light distribution pattern formed by light emitted from the two light emitting elements 44A and reflected by the reflector 360L positioned on the left side. The additional light distribution pattern PBR is formed as a horizontally-long light distribution pattern that is relatively large, and partially overlaps a right end portion of the basic light distribution pattern PH0 at a left end portion thereof.

Lateral diffusion angles of the low-beam light distribution pattern PL3 can be increased by adopting the configuration of the present modification. In addition, the additional light distribution patterns PBR and PBL formed by the reflection light from the reflectors 360L and 360R are much larger than the additional light distribution pattern PB3, so that the unevenness of light distribution of the low-beam light distribution pattern PL3 can be reduced, and a diffusion region thereof can be expanded to both the left and right sides.

The pair of left and right reflectors 360L and 360R are disposed to form the pair of left and right additional light distribution patterns PBR and PAL, whereby the lateral diffusion angles of the high-beam light distribution pattern PH3 can be increased.

The numerical values shown as the specifications in the above embodiment and the modifications thereof are merely examples, and these values may be appropriately set to different values.

The present invention is not limited to the configurations described in the above embodiment and modifications thereof, and various other modifications may be adopted.

What is claimed is:

1. A vehicle lamp comprising:

a lamp unit configured such that emitted light from a light source is emitted toward the front of the lamp via a projection lens, wherein the lamp unit includes first and second light sources as the light source, which are turned on at respective required turning on modes, wherein the first light source includes at least one light emitting element disposed in a vicinity of a rear focal point of the projection lens, wherein the second light source includes at least one light emitting element disposed at a position obtained by being moved from the rear focal point in a front-rear direction above the rear focal point, and wherein light emitting elements including the first light source and light emitting elements including the second light source are mounted on the same substrate extending obliquely in the front-rear direction of the lamp relative to a vertical plane orthogonal to the front-rear direction of the lamp.

2. The vehicle lamp according to claim 1, wherein a light emitting area of the second light source is set to a value larger than a light emitting area of the first light source.

3. The vehicle lamp according to claim 1, further comprising:

a second lamp unit configured to selectively form a low-beam light distribution pattern and a high-beam light distribution pattern, wherein the second lamp unit is configured such that brightness of the low-beam light distribution pattern is reinforced by turning on the second light source, and brightness of the high-beam light distribution pattern is reinforced by turning on the first light source.

4. The vehicle lamp according to claim 1, wherein the substrate is inclined toward the front of the lamp relative to the vertical plane.

5. The vehicle lamp according to claim 1, wherein the lamp unit includes a pair of reflectors disposed on left and right sides of the second light source, and wherein the reflectors are configured to reflect the emitted light from the second light source toward the projection lens.

* * * * *